United States Patent [19]

Morris

[11] 4,324,007

[45] Apr. 13, 1982

[54] SANITATION SYSTEM PARTICULARLY FOR MARINE CRAFT

[76] Inventor: Nathan Morris, Kentmorr, Stevensville, Md. 21666

[21] Appl. No.: 94,724

[22] Filed: Nov. 15, 1979

[51] Int. Cl.[3] ..... E03D 1/00; E03D 9/10

[52] U.S. Cl. ..... 4/321; 4/319; 4/323; 4/508; 210/173

[58] Field of Search ..... 4/319, 320, 321, 323, 4/508; 210/152, 173

[56] References Cited

U.S. PATENT DOCUMENTS

| | | | |
|---|---|---|---|
| 1,996,325 | 4/1935 | Cox | 4/320 X |
| 2,858,939 | 11/1958 | Corliss | 4/320 X |
| 2,951,251 | 10/1969 | Belden | 4/320 |
| 3,044,077 | 7/1962 | Belden | 4/320 |
| 3,318,248 | 5/1967 | Rembold | 4/319 X |
| 3,474,467 | 10/1969 | Stinson | 4/320 |
| 3,510,000 | 5/1970 | Carlson | 210/152 |
| 3,528,462 | 9/1970 | Quase | 4/323 X |
| 3,537,111 | 11/1970 | Whitten, Jr. | 4/508 |
| 3,546,713 | 12/1970 | Gagne | 4/320 |
| 3,663,970 | 5/1972 | Drouhard, Jr. et al. | 4/319 |
| 3,666,103 | 5/1972 | Green | 4/319 X |
| 3,699,592 | 11/1972 | Minchak | 4/320 |
| 3,730,884 | 5/1973 | Burn et al. | 4/321 X |
| 3,733,617 | 5/1973 | Bennett | 4/320 |
| 3,762,553 | 9/1973 | Reisso | 210/152 |
| 3,820,488 | 6/1974 | Johnson | 4/321 X |
| 3,878,569 | 4/1975 | Peirish, Jr. et al. | 4/319 |
| 3,922,976 | 12/1975 | Davis | 4/319 |
| 3,936,888 | 2/1976 | Sturtevant | 4/320 |
| 3,997,925 | 12/1976 | Hough | 4/508 |
| 4,032,995 | 7/1977 | Kemper | 4/319 |
| 4,092,248 | 5/1978 | Lamb | 210/152 |
| 4,115,876 | 9/1978 | Cole, Jr. et al. | 4/320 X |
| 4,131,959 | 1/1979 | Albertassi et al. | 4/319 |
| 4,133,058 | 1/1979 | Baker | 4/508 X |
| 4,161,792 | 7/1979 | Dallen et al. | 4/319 X |

*Primary Examiner*—Henry K. Artis
*Attorney, Agent, or Firm*—Shapiro and Shapiro

[57] ABSTRACT

A macerator/ejector pump within a waste material holding tank on a boat liquefies solid waste material in the tank and pumps the liquefied waste material through a discharge line adapted for connection to an on-shore waste collection system. The macerator/ejector pump comprises a pump and a plurality of cutter blades pitched to direct the liquefied waste to the intake port of the pump, the pump and the cutter blades being driven by a shaft connected to an electric motor mounted on the top of the holding tank. The holding tank may be discharged into the on-shore waste collection system without requiring a shore-based pump-out station. A plurality of rods extend into the holding tank for sensing the level of waste material, and a holding tank monitor displays this level by means of colored indicator lamps.

20 Claims, 7 Drawing Figures

FIG. 3.
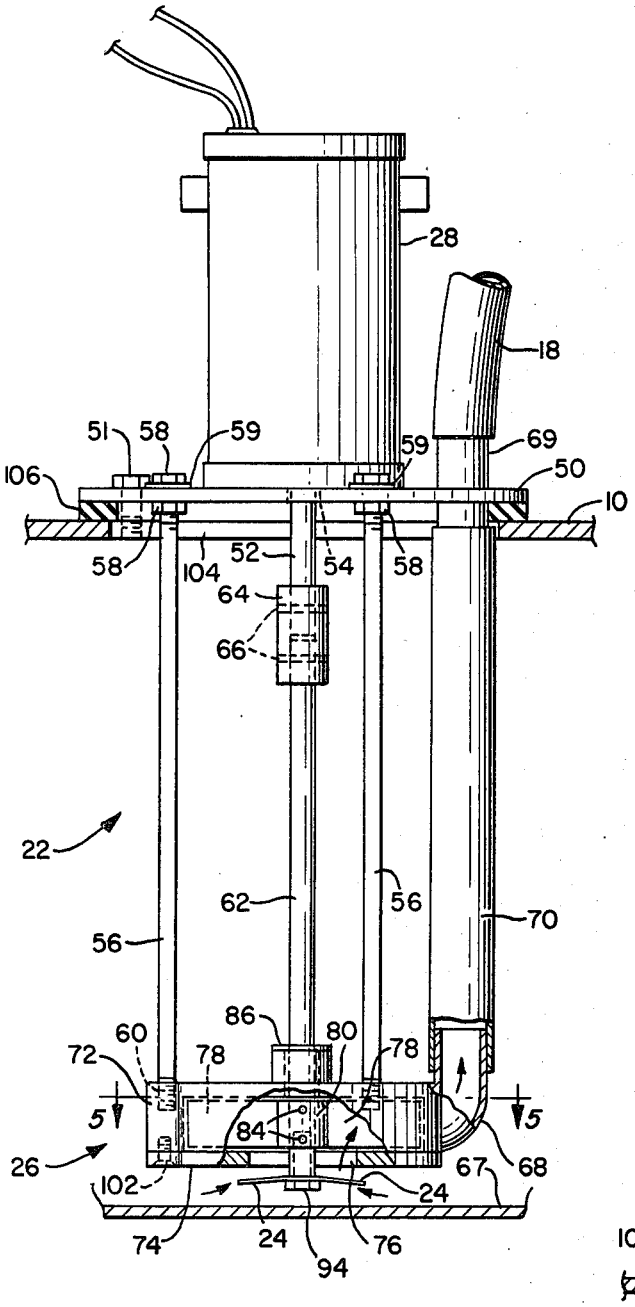
FIG. 5.
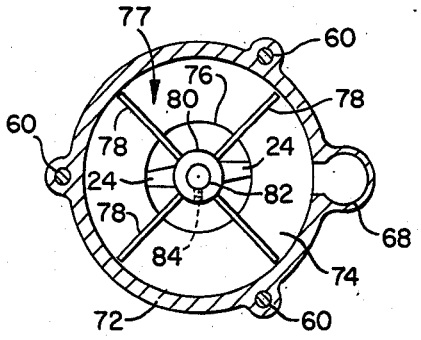
FIG. 6.
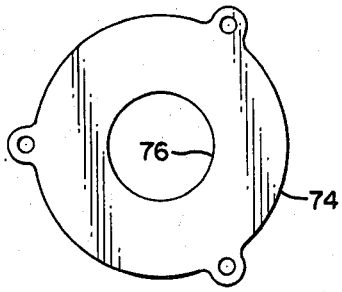
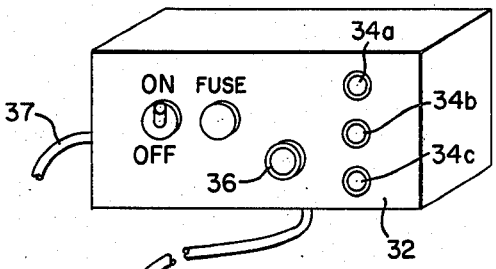
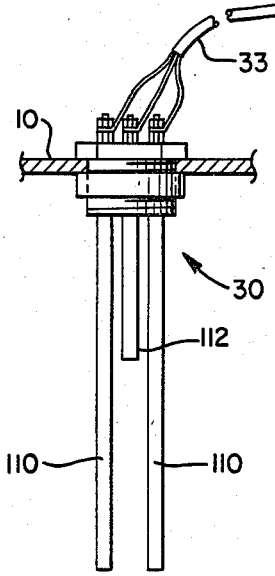
FIG. 7.
FIG. 4.
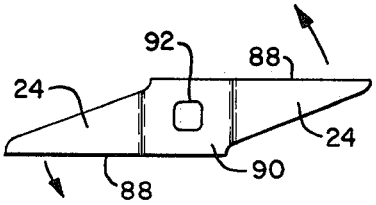

SANITATION SYSTEM PARTICULARLY FOR MARINE CRAFT

BACKGROUND OF THE INVENTION

The invention relates to a new and improved waste disposal system for recreational vehicles and the like, and is primarily directed to a sanitation system for marine craft.

Waste disposal has long been a problem for the owners of boats and other types of recreational vehicles. In most places, the indiscriminate dumping of raw or untreated waste material is prohibited by environmental regulations. Accordingly, a variety of different waste disposal systems have been previously proposed. For example, chemical treatment systems treat waste material with chemicals to destroy the bacterial content. Generally, they employ a treatment tank into which the waste material from a water closet or head is placed. Chemicals are added to the treatment tank and allowed to interact with the waste material for a sufficient time to kill the bacteria. Many such systems employ macerators to chop or break up the waste material into small particles and to mix the waste material with the chemical solution in the tank to enhance chemical action. After a sufficient period of time for the bacteria to be killed or reduced to an acceptable level, the contents of the tank are discharged into the environment. Typical of such systems are those disclosed in Belden, U.S. Pat. No. 3,044,077 of July 17, 1962, and Russo, U.S. Pat. No. 3,762,553 of Oct. 2, 1973.

Chemical systems have a number of disadvantages. The chemicals which they employ are expensive and produce a strong unpleasant odor. Moreover, they are not always totally effective in killing bacteria, so that the discharged waste material may still cause pollution and environmental problems.

Another type of waste disposal system incinerates the waste material. Such systems typically employ a macerator unit to convert the waste material in a holding tank to a liquefied effluent. The liquefied waste material is then pumped to an incinerator unit where it is burned. Alternatively, the liquefied waste material may be fed in controlled amounts directly into the hot exhaust of an internal combustion engine where it is sterilized through calcination. Such systems are generally rather complex, requiring a complicated metering system to control the amount of liquefied waste material pumped from the tank to the incinerator or to the engine exhaust. Systems utilizing the heat of an engine exhaust to incinerate the waste material tend to be limited in the amount of waste which can be handled. Furthermore, such systems are not practical on sailboats. Typical of these systems ae those disclosed in Sturtevant, U.S. Pat. No. 3,936,888 of Feb. 10, 1976, and Dallen, et al, U.S. Pat. No. 4,161,792 of July 24, 1979.

Increasingly strict Federal and State environmental regulations prohibit the discharge of even treated waste material in certain areas, such as inland waterways and lakes. Chemical and incinerator type waste disposal systems cannot be used in these areas. For boat owners, this means that waste material must be retained onboard in a holding tank. Shore-based pump-out facilities are necessary to collect the waste material from boats. However, very few marine pump-out facilities exist to accommodate boats requiring waste disposal services. Those that do exist commonly have a single pump-out station at a fixed location. This requires that the boat owner bring his boat to that particular point in a marina, for example, to have his holding tank pumped out. This is not only inconvenient, but it is also expensive.

Typically, the holding tanks on small boats have limited capacities, e.g., 20 to 30 gallons, and must be pumped out frequently. Moreover, holding tanks on boats generally do not have any means for monitoring the level of waste material in the tank. A boat owner, rather than risk the chance of an overflow, desires to discharge his holding tank frequently. The expense and inconvenience of having to take his boat to a pump-out station are an incentive for him to disregard the regulations and surreptitiously discharge the holding tank directly into the water, frustrating the purposes of the environmental regulations.

SUMMARY OF THE INVENTION

An object of the invention is to provide a new and improved sanitation system having general utility in vehicles and being particularly adapted for use in recreational vehicles.

Another object of the invention is to provide a marine sanitation system which does not require shore-based pump-out facilities.

A further object is to provide a marine sanitation system which allows a holding tank to be discharged into an on-shore collection tank or into a municipal sewage system.

An additional object is to provide a sanitation system which is readily adaptable to existing marine sanitation systems and which is simple and convenient to use.

Another object is to provide a sanitation system in which the level of waste material in a holding tank can be monitored.

Briefly stated, in a preferred embodiment, a sanitation system for vehicles in accordance with the invention employs a motor adapted to be mounted on a holding tank, an elongated shaft coupled to the motor and adapted to extend into the tank, a pump connected to the elongated shaft adjacent to its end for discharging the contents of the holding tank, and cutter blade means attached to the end of the shaft beneath the pump for macerating solids in the holding tank. The cutter blade means is pitched to direct the liquefied waste material to the inlet of the pump.

In accordance with another aspect of the invention, a marine sanitation system employs an on-board holding tank for waste material, a macerator within the tank for liquefying solids, an outlet from the tank adapted for connection to an on-shore waste collection system, and a pump for pumping the contents of the tank to the on-shore collection system. Means may also be employed for monitoring the level of waste material in the tank to indicate when it should be emptied.

BRIEF DESCRIPTION OF THE DRAWINGS

FIG. 3 is an elevation view of a macerator/ejector pump, partially broken away;

FIG. 4 is a plan view of one of the cutter blades employed by the system of the invention;

FIG. 5 is a sectional view taken approximately along line 5—5 of FIG. 3;

FIG. 6 is a plan view of a base cover plate of the pump of FIG. 3; and

FIG. 7 is a diagrammatic view of a waste level sensor and a waste level monitor which may be employed with the invention.

DESCRIPTION OF THE PREFERRED EMBODIMENT

Figure 1:
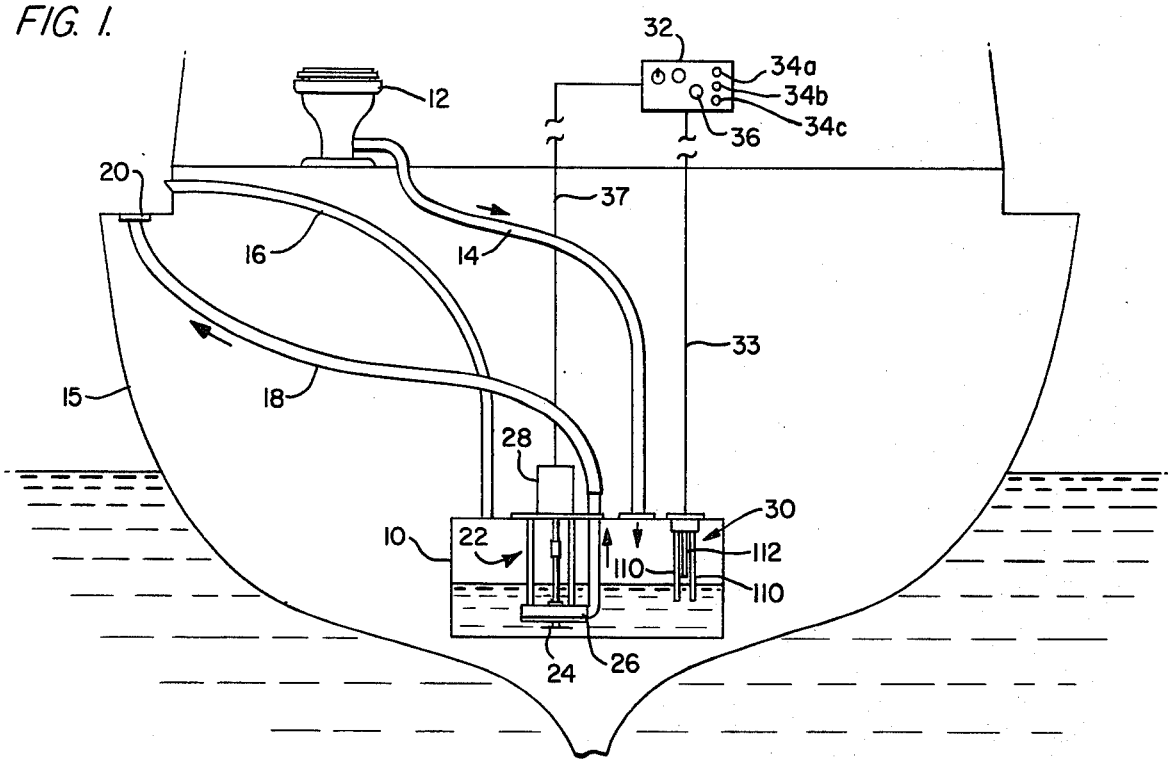
FIG. 1 is a diagrammatic view illustrating a marine sanitation system embodying the invention.

The invention preferably is employed in a marine sanitation system as illustrated in FIG. 1. Generally, the system includes a holding tank 10 for receiving waste material from a head 12 via a line 14. Preferably, holding tank 10 is located in a lower portion of the boat 15 so that waste material and liquid from head 12 flow into the tank by gravity when the head is flushed. A vent pipe 16 vents the holding tank and a discharge line 18 is connected between the tank and a waste discharge fitting 20 mounted on the deck of the boat.

A macerator/ejector pump, designated generally by the reference numeral 22, is located within the holding tank. As will be described in more detail hereinafter, the macerator/ejector pump comprises a plurality of cutter blades 24 and a pump 26 driven on a common shaft by an electrical motor 28 mounted on the holding tank. When the motor is energized, cutter blades 24 rotate at a relatively high speed to macerate the solid waste material in the tank, converting it to a liquefied slurry, and pump 26 pumps the liquefied waste through discharge line 18 to discharge the tank.

Also located in the holding tank is a waste level sensor 30 for sensing the level of waste material in the tank. A remote holding tank monitor 32 connected to the waste level sensor by an electrical cable 33 indicates the level of waste material in the tank. The holding tank monitor, shown in more detail in FIG. 7, may be located on the instrument panel of the boat, for example, and may have a plurality of colored indicator lamps 34*a–c* for indicating the level of waste material in the holding tank. The holding tank monitor may also include a switch 36 for controlling the operation of motor 28 which drives the macerator/ejector pump, via an electrical cable 37 (FIG. 1).

Waste level sensor 30 and holding tank monitor 32 indicate to the boat owner when the holding tank should be discharged. The macerator/ejector pump permits the boat owner to discharge the holding tank into an on-shore collection system, as required, without the necessity of a pump-out facility.

Figure 2:
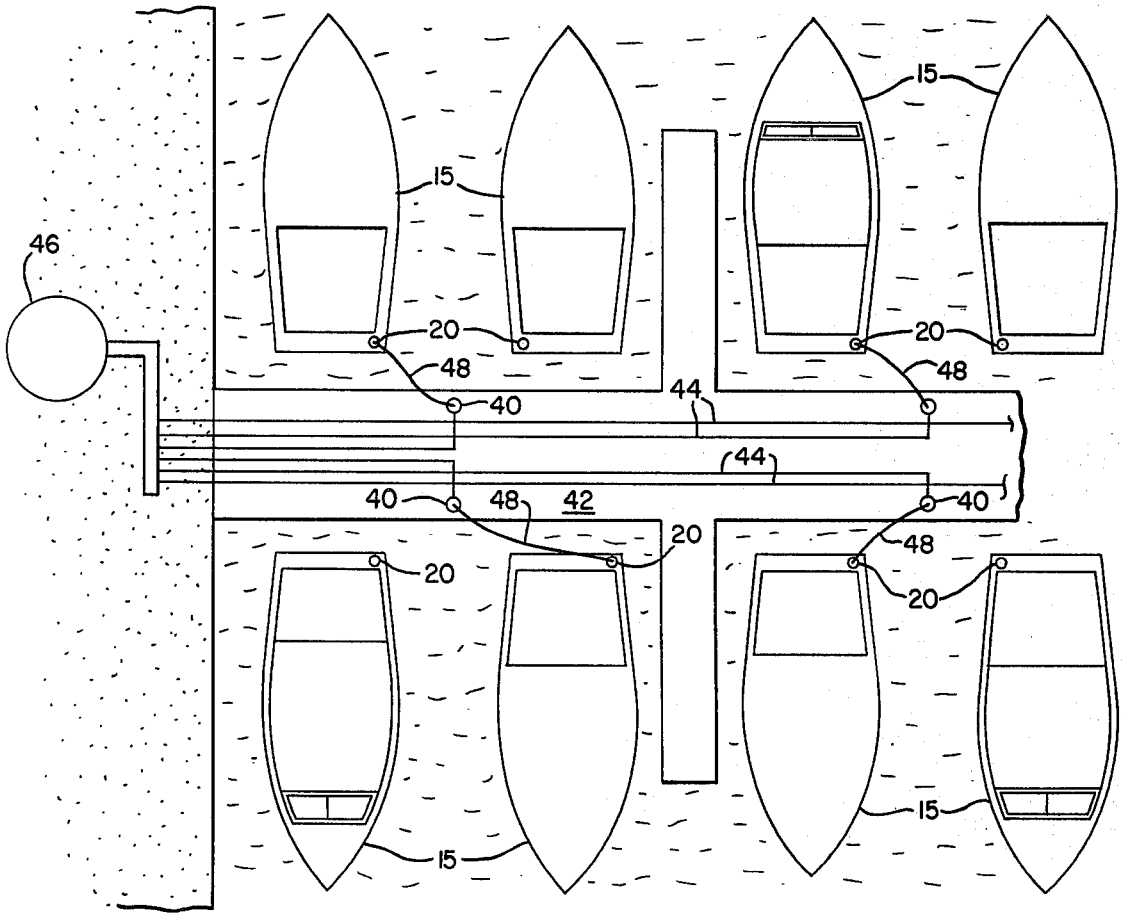
FIG. 2 is a diagrammatic view illustrating an on-shore waste collection system for use with the system of FIG. 1.

The on-board sanitation system may be advantageously employed with the on-shore waste collection system illustrated in FIG. 2. As shown, a plurality of waste pick-up fittings 40 may be spaced at convenient locations on a pier or dock 42, as at a marina. For example, the waste pick-up fittings may be placed between adjacent boat slips, as illustrated, so that each fitting is accessible by two or more boats. A plurality of waste lines 44, preferably of plastic pipe such as PVC, which is impervious to rust, may be placed below the dock to connect the waste pick-up fittings with an on-shore collection tank 46. Alternatively, waste lines 44 may discharge directly into a municipal sewage system (not illustrated) rather than a collection tank.

When a boat owner pulls into a slip at the dock, he will be conveniently located to a waste pickup fitting 40 and can easily discharge his holding tank without having to bring his boat to a single, fixed pump-out station at the marina. A short length of flexible hose 48 may be connected between the waste discharge fitting 20 on the deck of the boat and a waste pick-up fitting 40 on the dock. Fittings 20 and 40 are preferably quick-disconnect fittings to facilitate hook-up. When the hook-up is completed, the macerator/ejector pump 22 is activated by switch 36 on the holding tank monitor. The macerator/ejector pump liquefies the solid waste material within the holding tank and pumps it under pressure through hose 48 and waste line 44, where, aided by gravity, the waste material flows into the collection tank 46. Since the liquefied waste material pumped from the tank is a slurry, having no large solid particles, waste lines 44 may be small diameter, e.g., one-inch, pipe.

The entire discharge operation can be completed within a matter of minutes, at a discharge point chosen by the boat owner at his convenience, thus providing an incentive for the boat owner to comply with waste disposal regulations. As is apparent from the foregoing, the on-shore waste collection system is simple and can be easily installed at existing facilities.

FIG. 3 illustrates the macerator/ejector pump 22 of the invention in detail. As shown, electric motor 28 is supported on a mounting plate 50, which may be circular, for example, mounted on holding tank 10 in a conventional manner as with bolts 51. The motor shaft 52 extends into the holding tank through an opening 54 in the mounting plate. Pump 26, preferably a centrifugal, submersible pump which requires no priming, is supported within the holding tank by a plurality of support rods 56, preferably of stainless steel or other non-corrosive material. The support rods may have threaded ends and be attached to mounting plate 50 as with nuts 58 and washers 59. The opposite end of each support rod may be threaded into a hole 60 (FIG. 5) in the pump body. The pump is driven by an elongated shaft 62 connected to motor shaft 52 by coupling 64 and roll pins 66.

Cutter blades 24 are connected to the end of shaft 62 which extends a short distance through the pump, and are disposed below the pump adjacent to its intake port, as will be explained hereinafter. Cutter blades 24 and pump 26 are positioned within the tank so that they are adjacent to its bottom 67. Preferably, cutter blades 24 are approximately one-half inch from the bottom of the tank. The discharge port 68 of the pump is connected to a fitting 69 in mounting plate 50 via a hose 70, preferably of plastic material. Discharge line 18 is connected to fitting 69 so that the contents of the tank may be discharged when the pump is operated.

Referring to FIGS. 3, 5 and 6, pump 26 generally comprises an inverted cup-shaped pump body 72 and a base cover plate 74, both preferably of cast bronze. An opening 76 in the base cover plate serves as an intake for the pump. Within the pump body is an impeller assembly 77, also preferably of cast bronze. The impeller assembly comprises a plurality of impeller blades 78 which radiate from a collar 80 having a hole 82 therein which is sized to allow the collar to be attached to elongated shaft 62, as with set screws 84 (FIGS. 3 and 5). Preferably, shaft 62 has a flat (not illustrated) for this purpose. As shown in FIG. 3, a nylon bushing 86 in the pump body serves as a bearing for shaft 62. When shaft 62 rotates, impeller blades 78 draw the liquefied waste and fluids in the tank into the pump through opening 76 in the base cover plate, and discharge them through discharge port 68 and discharge line 18.

FIG. 4 illustrates the cutter blades 24 of the macerator/ejector pump assembly. Cutter blades 24, preferably formed of stainless steel, comprise a pair of cutting surfaces 88 extending from either side of a central portion 90. A hole 92 in the central portion 90, which may be square as illustrated, allows the cutter blades to be keyed to shaft 62. The shaft may have a squared end portion to mate with hole 92 and be tapped to receive a bolt 94 for attaching the cutter blades to the end of the shaft, which preferably rotates in a direction to tighten bolt 94. As best illustrated in FIG. 3, the cutter blades are pitched slightly downward from the central portion 90, and are positioned adjacent to intake 76 of the pump. The pitch of the cutter blades directs the macerated solids toward the intake of the pump and improves the efficiency of the pump in discharging the holding tank. Preferably, cutter blades 24 are rotated at a relatively high rate by motor 28, so that they act much like the blades in a home blender to macerate the solids in the tank and convert them into a liquefied slurry. In the preferred embodiment, electric motor 28 rotates at approximately 3,100 RPM and has a rating of $\frac{1}{8}$ hp. As the solids are macerated, they are directed toward intake 76, sucked into the pump, and discharged from the holding tank. As previously noted, cutter blades 24 are disposed beneath pump 26 and are not surrounded by the pump housing. This provides relatively unobstructed access to the cutter blades and is a significant advantage of the invention, since there is less possibility of the cutter blades becoming clogged with solids when they are not enclosed within a housing. The relatively high rate of rotation also helps to prevent clogging of the cutter blades and aids in directing the liquefied waste to the pump intake.

To assemble the macerator/ejector pump, elongated shaft 62 may first be placed through the nylon bushing 86 and the pump body 72 by a sufficient distance to allow collar 80 of the impeller assembly 77 to be attached to the shaft. The pump body is then lowered over the impeller blades and the base cover plate 74 attached to the pump body, such as by counter-sunk screws 102. Hose 70 may then be connected to the pump discharge port 68 and fitting 69, elongated shaft 62 coupled to motor shaft 52 with coupling 64, and support rods 56 secured to the mounting plate 50. Finally, cutter blades 24 may be attached to the end of shaft 62. The mounting plate may then be secured to the top of holding tank 10 with the macerator/ejector pump 22 extending through an opening 104 into the tank. A resilient gasket 106 may be used between the mounting plate and the tank to provide a seal and to damp the vibrations caused by the motor.

Preferably, mounting plate 50, coupling 64 and hose 70 are formed from non-conductive materials, such as PVC, to electrically isolate the motor from the tank and the macerator/ejector pump assembly. This prevents electrical shock in the event of a short circuit.

Fluid level sensors and monitors suitable for use with this system to measure the level of waste material in the holding tank are well known. In general, float-type systems ar not suitable, due to the motion and the rocking of the boat. A preferred sensor (FIG. 7) comprises a pair of equal length rods 110, preferably of stainless steel, which extend into the holding tank to approximately the one-third to one-half full level. A third rod 112, also of stainless steel, is shorter than rods 110 and extends into the tank to about the three-fourths full level. As the level of waste material in the tank rises and contacts rods 110, a source of electrical current (not illustrated) within holding tank monitor 32 connected between rods 110 causes an electrical current to flow between the rods, since the waste material is conductive due to its high salt content. This current may be used to turn on one of a plurality of indicator lamps 34 a–c on the holding tank monitor to indicate that the tank is one-third to one-half full. As the level of the waste material continues to rise and contacts rod 112, current will flow between rods 110 and 112, and another lamp on the holding tank monitor may be illuminated to indicate that the tank is approximately three-quarters full and should be emptied.

Holding tank monitor 32 preferably includes at least three indicator lamps of different colors. A green indicator lamp **34*a* may be used to indicate that the system is on. An amber lamp 34*b* may be used to indicate that the holding tank is one-third to one-half full, and a red lamp 34*c*** may be used to indicate that the tank is three-quarters full. This is a convenient way of informing the boat owner of the level of waste material in the holding tank.

From the foregoing, it can be appreciated that the sanitation system of the invention provides a simple, efficient and convenient system for recreational vehicles such as boats. It allows easy determination of the level of waste material in a holding tank, and permits quick and convenient discharge of the holding tank into an onshore sewage system. Also, the system is easily adaptable to existing sanitation systems, and traditional pump-out facilities may still be employed for discharging the holding tank, if desired.

While the foregoing description has been with reference to a particular embodiment, it will be appreciated by those skilled in the art that variations are possible without departing from the principles and spirit of the invention, the scope of which is defined by the appended claims.

I claim:

1. An active sanitation system for vehicles having a holding tank for waste material comprising a motor adapted to be mounted on the holding tank, an elongated shaft adapted to extend into the holding tank, a coupling for coupling a first end of the shaft to the motor, a pump connected to the elongated shaft adjacent to a second end for discharging waste material from the holding tank, and cutter blade means attached to the second end of the shaft adjacent to an intake port of the pump for liquefying waste material in the holding tank, the cutter blade means being pitched to direct the liquefied waste material to the intake port of the pump to assist the pump in discharging the waste material from the holding tank and being free of confining structure so that the cutter blade means has unobstructed access to the waste material.

2. The system of claim 1, wherein the cutter blade means and the pump are disposed in the holding tank adjacent to its bottom.

3. The system of claim 2, wherein the pump intake port is positioned above the cutter blade means and the elongated shaft extends through the pump and through the intake port.

4. The system of claim 3, wherein the cutter blade means comprises a cutter blade having a central portion formed for attachment to the shaft and at least a pair of cutting portions extending outwardly from the central portion and being pitched downwardly from the second end of the shaft.

5. The system of claim 4 comprising a mounting plate on which the motor is mounted and a plurality of support rods connected to the mounting plate and extending into the tank for supporting the pump therein.

6. The system of claim 5, wherein the pump has a discharge port connected to a fitting secured to the mounting plate, the fitting being formed for connection to a discharge line through which the waste material from the holding tank may be discharged.

7. The system of claim 6, wherein the mounting plate and the coupling are of non-conductive materials for electrically isolating the motor.

8. The system of claim 7 comprising means for sensing the level of waste material in the tank and means for indicating such level.

9. The system of claim 8, wherein the means for sensing comprises a plurality of rods extending into the holding tank, and the means for indicating includes a plurality of indicator lamps adapted to be illuminated when current flows between two or more of the rods.

10. An active marine sanitation system for a boat comprising an on-board holding tank for waste material, a macerator within the holding tank for liquefying the waste material, an outlet from the holding tank adapted for connection to a passive on-shore waste collection system, and a pump disposed within the holding tank and connected to the outlet for pumping the liquefied waste material to the on-shore collection system, the macerator comprising a cutter blade positioned adjacent to an intake port of the pump, said cutter blade configured to direct liquefied waste material to the pump to assist the pump in discharging the waste material from the holding tank, the cutter blade being free of confining structure so that the cutter blade has unobstructed access to the waste material.

11. The system of claim 10 comprising a motor mounted on the tank and an elongated shaft coupled to the motor for driving the pump and the cutter blade.

12. The system of claim 11, wherein the elongated shaft extends through the pump and the cutter blade is attached to an end of the elongated shaft below the pump and is positioned between the pump and the bottom of the holding tank.

13. The system of claim 12, wherein the cutter blade comprises a central portion formed for attachment to the end of the shaft and at least two cutting portions extending outwardly from the central portion and being pitched downwardly from the end of the shaft.

14. The system of claim 13, wherein the outlet from the holding tank comprises a discharge line having one end connected to the pump and the other end connected to a waste discharge fitting adapted for connection to the on-shore waste collection system.

15. The system of claim 14 comprising means for sensing the level of waste material in the holding tank and means for indicating such level.

16. The system of claim 15, wherein the means for sensing comprises a plurality of rods extending into the tank and the means for indicating includes a plurality of indicator lamps adapted to be illuminated when electrical current flows between said rods.

17. A marine sanitation system comprising passive on-shore waste collection means, a plurality of spaced waste pick-up fittings, and means for connecting the waste pick-up fittings to the on-shore waste collection means, each waste pick-up fitting being disposed on a dock adjacent to one or more boat slips and adapted for connection to an active waste disposal system on-board a boat, said waste disposal system comprising a holding tank for waste material, a macerator within the housing tank for liquefying the waste material, an outlet from the holding tank adapted for connection to a waste pick-up fitting and a pump disposed within the holding tank and connected to the outlet for pumping the liquefied waste material to the on-shore waste collection means, the macerator comprising cutter blade means positioned adjacent to an intake port of the pump, the cutter blade means being free of confining structure so that the cutter blade means has unobstructed access to the waste material, and the cutter blade means being configured to direct liquefied waste material to the pump to assist the pump in pumping the liquefied waste material to the on-shore waste collection means.

18. The system of claim 17, wherein the on-shore waste collection means comprises a waste collection tank and the means for connecting the waste pick-up fittings to the waste collection tank comprises a plurality of lines, one line connected to each fitting.

19. The system of claim 18, wherein the outlet comprises a waste discharge fitting mounted on the deck of the boat and means connecting the waste discharge fitting to said waste pick-up fitting, the waste discharge fitting and the waste pick-up fitting being quick-disconnect type fittings.

20. The system of claim 3, wherein the cutter blade means is positioned between the pump and the bottom of the holding tank.

* * * * *